US008506461B2

(12) United States Patent
Huang et al.

(10) Patent No.: US 8,506,461 B2
(45) Date of Patent: Aug. 13, 2013

(54) MULTIFUNCTION DUMBBELL

(76) Inventors: Ming-Hsiung Huang, Da-an Township, Taichung County (TW); Wei-Chen Wang, Da-an Township, Taichung County (TW)

( * ) Notice: Subject to any disclaimer, the term of this patent is extended or adjusted under 35 U.S.C. 154(b) by 324 days.

(21) Appl. No.: 12/955,221

(22) Filed: Nov. 29, 2010

(65) Prior Publication Data

US 2012/0135844 A1 May 31, 2012

(51) Int. Cl.

| | |
|---|---|
| ***A63B 21/072*** | (2006.01) |
| ***A63B 21/045*** | (2006.01) |
| ***A61H 15/00*** | (2006.01) |
| ***A61N 2/08*** | (2006.01) |

(52) U.S. Cl.

USPC ..... 482/108; 482/45; 482/50; 482/79; 482/126; 482/127; 482/132; 601/135; 600/15

(58) Field of Classification Search

USPC ..... 482/44–46, 49, 50, 79, 80, 91–93, 482/106–110, 121, 122, 126, 127, 132; 601/121, 135; 600/9, 15

See application file for complete search history.

(56) References Cited

U.S. PATENT DOCUMENTS

| | | | | |
|---|---|---|---|---|
| 3,184,234 | A * | 5/1965 | Struble | 482/46 |
| 4,852,873 | A * | 8/1989 | O'Donnell et al. | 482/126 |
| 5,046,727 | A * | 9/1991 | Wilkinson et al. | 482/45 |
| 5,263,908 | A * | 11/1993 | Chen | 482/44 |
| 5,580,336 | A * | 12/1996 | Coallier | 482/44 |
| 5,653,664 | A * | 8/1997 | Jennings | 482/93 |
| 5,707,325 | A * | 1/1998 | Chiou | 482/132 |
| 6,071,214 | A * | 6/2000 | Osterman | 482/44 |
| 6,773,377 | B1 * | 8/2004 | Yu et al. | 482/45 |
| 7,387,599 | B1 * | 6/2008 | Hsu | 482/132 |
| 7,462,140 | B1 * | 12/2008 | Lombardozzi | 482/82 |
| 8,157,709 | B2 * | 4/2012 | Wilkinson et al. | 482/45 |
| 2007/0167298 | A1 * | 7/2007 | Bystrom | 482/93 |
| 2012/0077648 | A1 * | 3/2012 | Farrow et al. | 482/110 |
| 2012/0214650 | A1 * | 8/2012 | Jahns | 482/111 |

* cited by examiner

*Primary Examiner* — Loan Thanh
*Assistant Examiner* — Victor K Hwang
(74) *Attorney, Agent, or Firm* — Alan Kamrath; Kamrath IP Lawfirm, P.A.

(57) ABSTRACT

A multifunction dumbbell includes a handle having two projections on both ends respectively; two hollow weight members each having a protrusion extending toward the handle; two spacer sleeves each having a closed flange fixedly secured to a joining portion of the handle and either projection, with the spacer sleeves fixedly fastened between the protrusions and the projections; two rings each having an inner diameter less than an outer diameter of the weight member so that the rings can be put on the weight members and retained thereon respectively; two half-spherical members each fixedly secured to the ring and complimentarily engaged with the weight member; and two truncated conic springs each put on the protrusion and a portion of the weight member to be retained between the spacer sleeve and the ring. The rings and the half-spherical members together are adapted to rotate about the weight members.

7 Claims, 12 Drawing Sheets

MULTIFUNCTION DUMBBELL

BACKGROUND OF THE INVENTION

1. Field of Invention

The invention relates to dumbbells and, more particularly, to a multifunction dumbbell for helping an exerciser achieve the purposes of physical exercise, massage, rehabilitation, physical fitness, and health improvement.

2. Description of Related Art

A dumbbell is a piece of equipment used in weight training. One type of dumbbell is a fixed-weight dumbbell which is a weight created in a dumbbell shape. Fixed-weight dumbbells have a disadvantage that is the strength of exercise is fixed. That is, some users may feel the strength of exercise of a certain type of fixed-weight dumbbell being not sufficient (i.e., being low intensity training), and some other users may feel the strength of exercise of another type of fixed-weight dumbbell being excessive (i.e., being high intensity training).

There are also adjustable dumbbells available. For an adjustable dumbbell, weight disks or plates are slid onto both ends of the dumbbell and secured with clips or collars. One type of adjustable dumbbell is a spinlock dumbbell. While the weights can be increased or decreased for satisfying personal needs, adjustable dumbbells are still monotonous. Often, an individual may seldom or even no longer use an adjustable dumbbell for exercise after using it for a number of times after buying.

Thus, the need for improvement still exists.

SUMMARY OF THE INVENTION

It is therefore one object of the invention to provide a multifunction dumbbell comprising a handle comprising two projections on both ends respectively; two hollow weight members each comprising a protrusion extending toward the handle; two spacer sleeves each comprising a closed flange fixedly secured to a joining portion of the handle and either of the projections, with the spacer sleeves fixedly fastened between the protrusions and the projections; two rings each having an inner diameter less than an outer diameter of the weight member so that the rings can be put on the weight members and retained thereon respectively; two half-spherical members each fixedly secured to the ring and comprising a concave inner surface shaped to complimentarily engage with the weight member; and two truncated conic springs each put on the protrusion and a portion of the weight member to be retained between the spacer sleeve and the ring. The rings and the half-spherical members together are adapted to rotate about the weight members.

The above and other objects, features and advantages of the invention will become apparent from the following detailed description taken with the accompanying drawings.

DETAILED DESCRIPTION OF THE INVENTION

Figure 1:
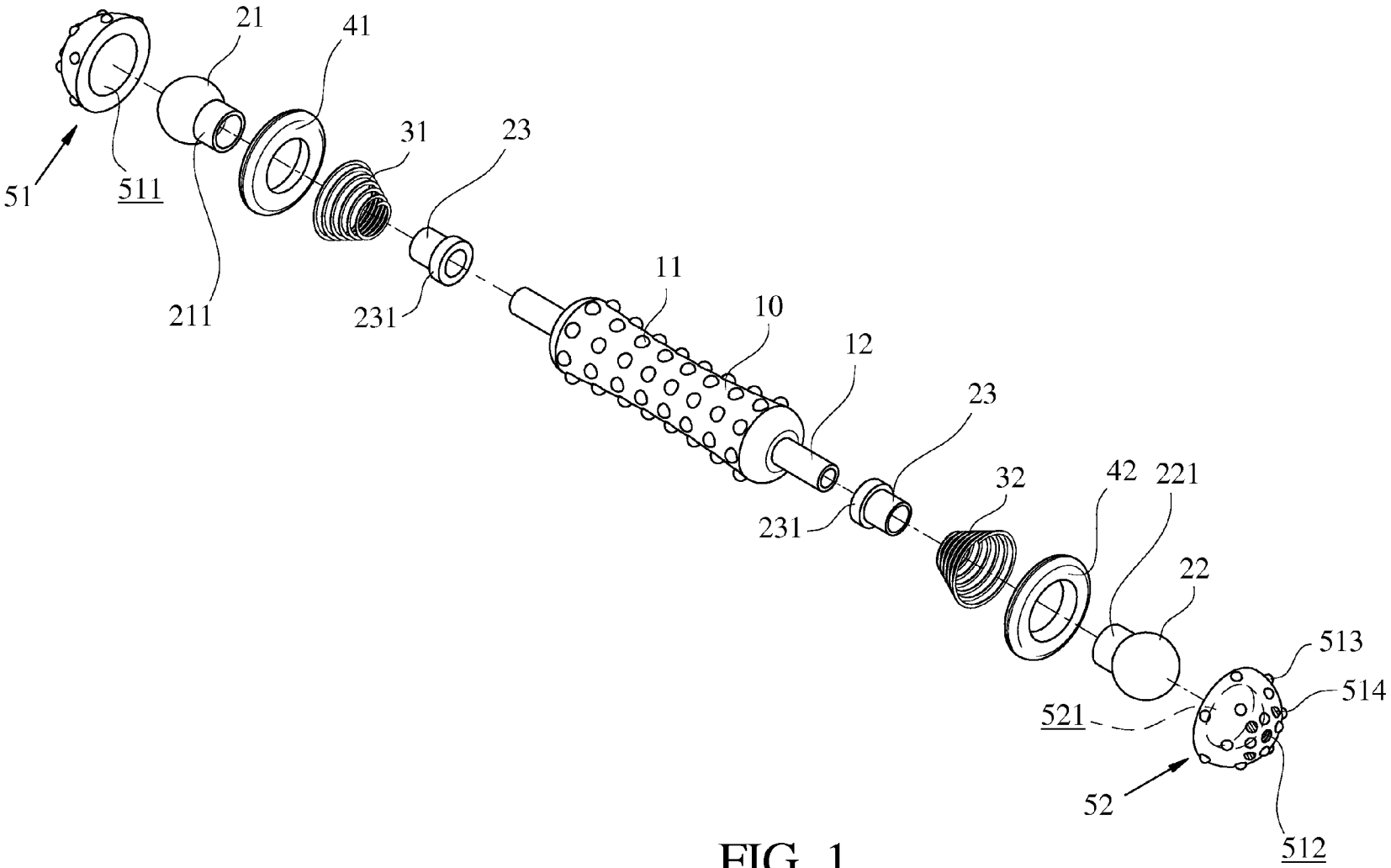
FIG. 1 is an exploded view of a multifunction dumbbell according to the invention.
Figure 2:
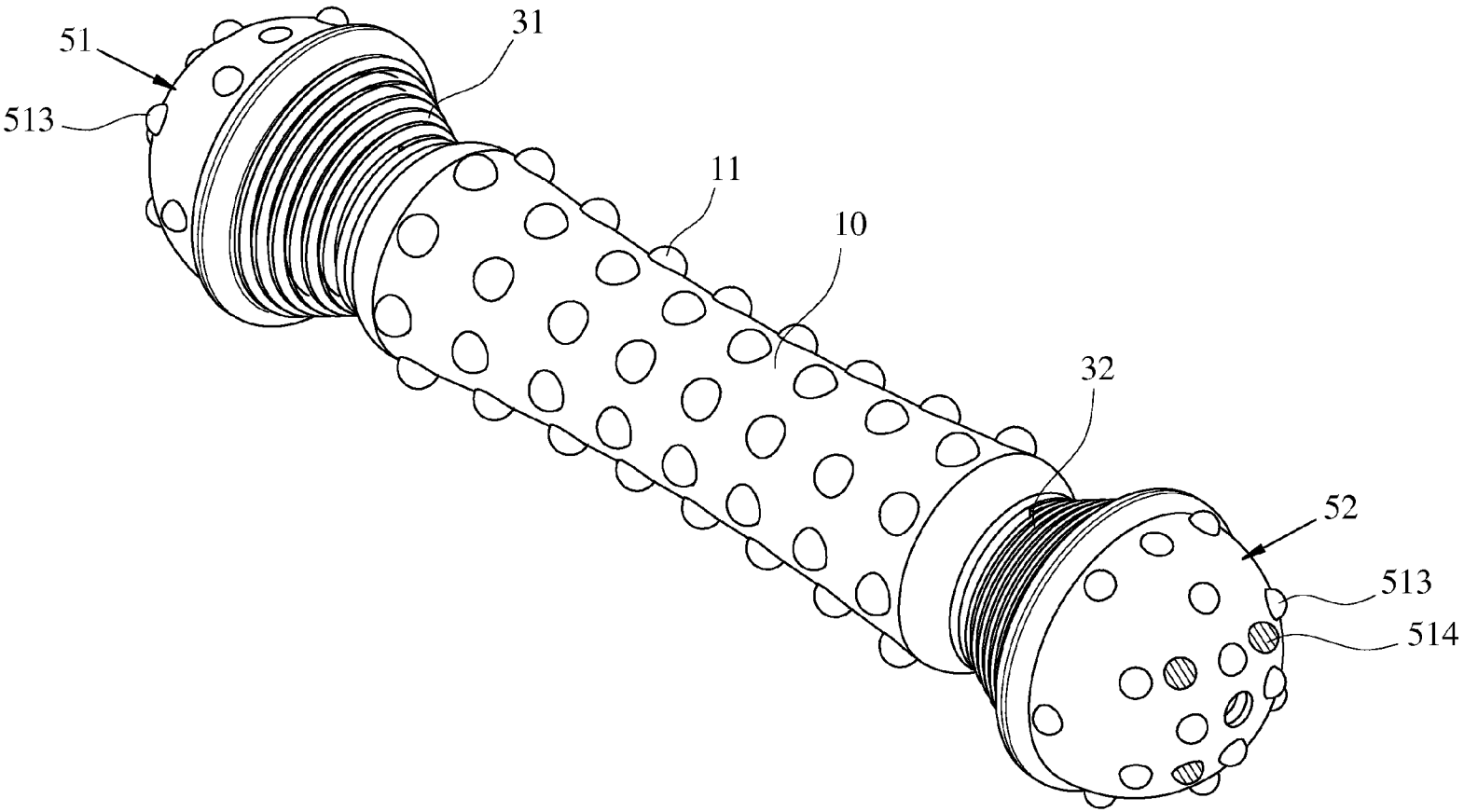
FIG. 2 is a perspective view of the assembled multifunction dumbbell.
Figure 3:
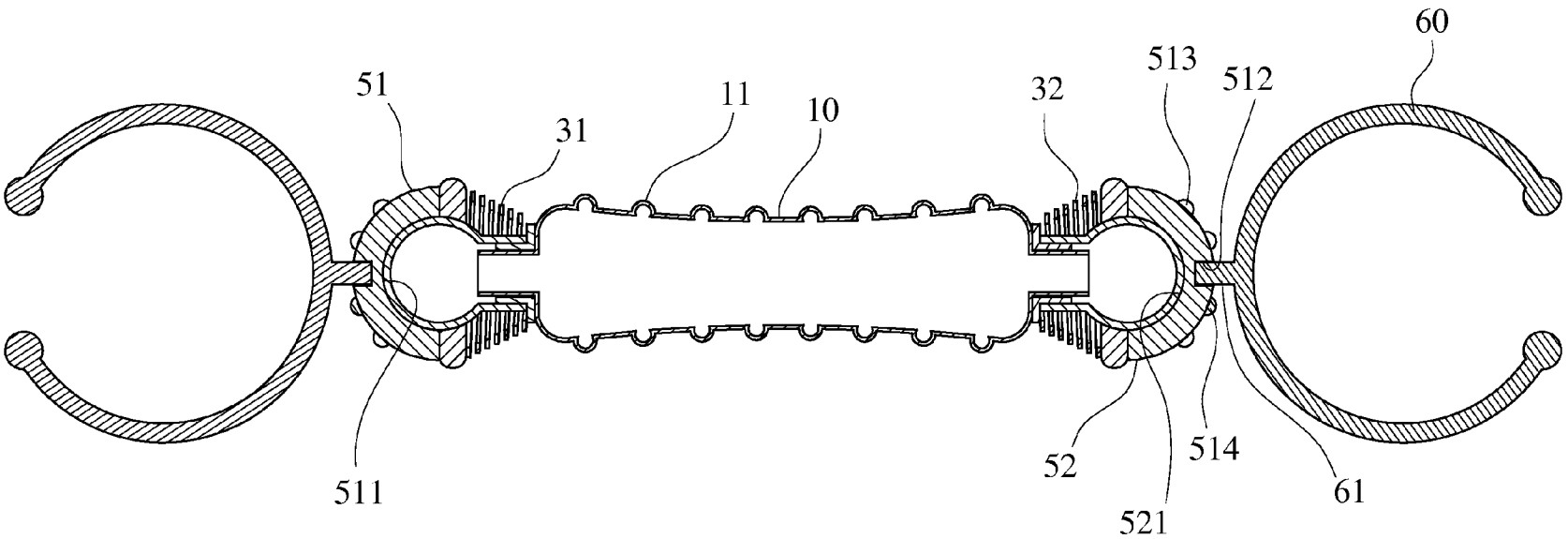
FIG. 3 is a longitudinal sectional view of the multifunction dumbbell of FIG. 2 with two C-shaped rings additionally secured to both ends of the multifunction dumbbell.
Figure 4:
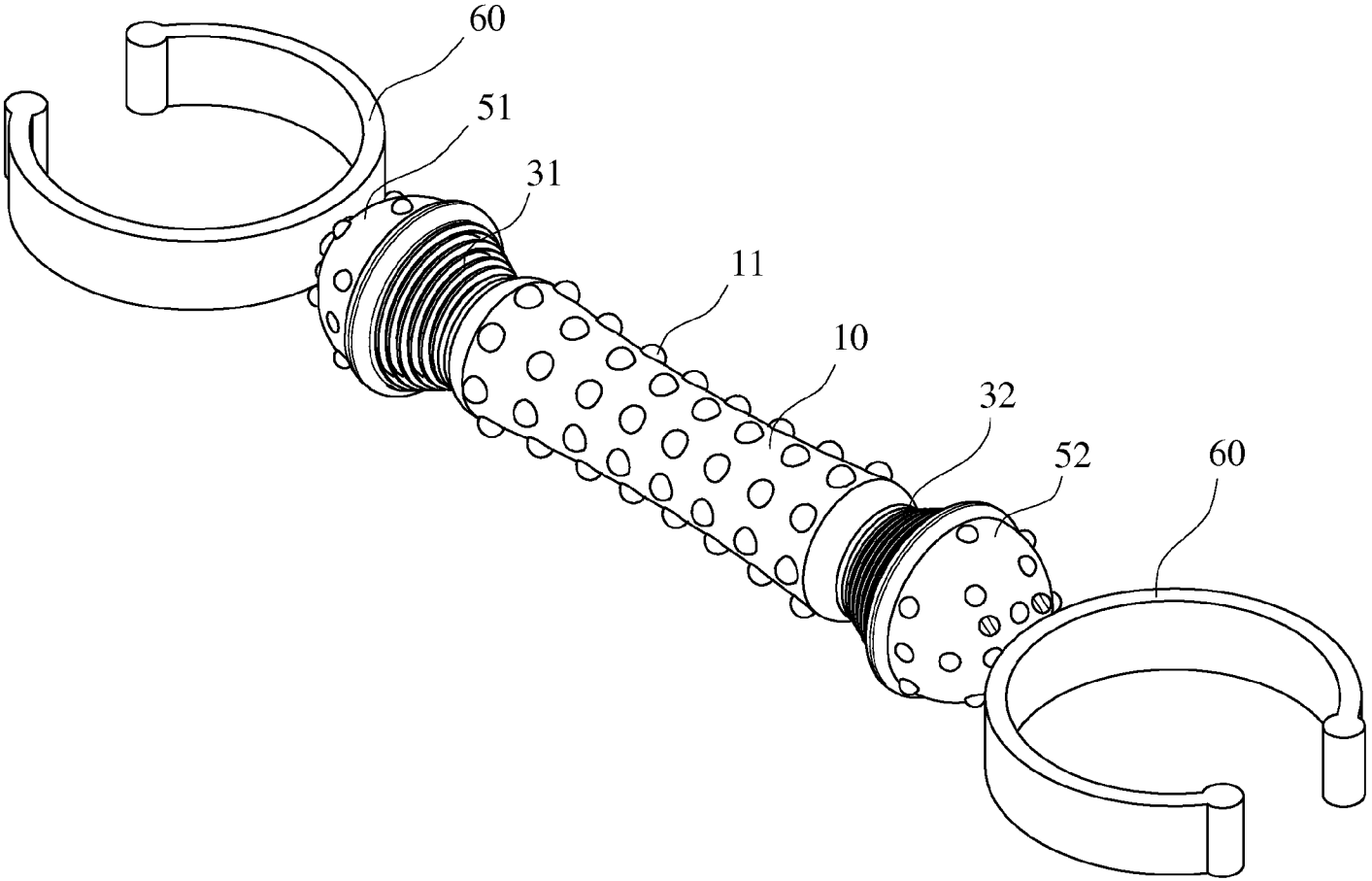
FIG. 4 is a perspective view of the multifunction dumbbell of FIG. 3.

Referring to FIGS. 1 to 9, a multifunction dumbbell in accordance with the invention comprises the following components as discussed in detail below.

A handle 10 is formed of thermoplastic. The handle 10 is substantially hollow, cylindrical and somewhat concave toward its center (i.e., having bell ends). The handle 10 comprises a plurality of massaging knobs 11 arranged in rows on an outer surface, and two hollow, cylindrical projections 12 on both ends respectively.

First and second weight members 21, 22 are each formed of thermoplastic and hollow. The first weight member 21 comprises a short, hollow, cylindrical protrusion 211 at one end of the handle 10, and the second weight member 22 comprises a short, hollow, cylindrical protrusion 221 at the other end of the handle 10. Weights between one and seven kilograms can be added in the hollow of each of the first and second weight members 21, 22.

Two spacer sleeves 23 each has an annular flange 231 fixedly secured to a joining portion of the handle 10 and either of the projections 12 (i.e., shoulder) by, for example, ultrasonic welding.

First and second rings 41, 42 each has an inner diameter less than an outer diameter of the first and second weight members 21, 22 respectively so that the first and second rings 41, 42 can be put on spherical portions of the first and second weight members 21, 22 and retained thereon respectively.

First and second half-spherical members 51, 52 are formed of thermoplastic. Each of the first and second half-spherical members 51, 52 has a concave inner surface 511 or 521 shaped to complimentarily engage with the first weight member 21 or the second weight member 22. On the outer surface of each of the first and second half-spherical members 51, 52, there are provided a plurality of massaging knobs 513, a plurality of magnets (e.g., lodestones) 514 for blood circulation and health improvement purposes, and a threaded hole 512. The first and second half-spherical members 51, 52 are fixedly secured to the first and second rings 41, 42 by, for example, ultrasonic welding respectively.

First and second truncated conic springs 31, 32 each has a tapered end facing one or the other end of the handle 10. The first and second truncated conic springs 31, 32 are put on the protrusions 211, 221 and portions of the first and second weight members 21, 22 respectively.

Moreover, the protrusions 211, 221 are fixedly secured to the spacer sleeves 23 by, for example, ultrasonic welding. Thus, the first truncated conic spring 31 is retained between one of the spacer sleeves 23 and the first ring 41 and the second truncated conic spring 32 is retained between the other spacer sleeve 23 and the second ring 42 respectively.

Therefore, the first and second truncated conic springs 31, 32 can exert an elastic force against the first and second rings 41, 42 respectively.

As a result, the handle 10, the spacer sleeves 23, the first and second weight members 21, 22, the first and second truncated conic springs 31, 32, the first and second rings 41, 42, and the first and second half-spherical members 51, 52 are assembled in which the handle 10, the spacer sleeves 23, the first and second weight members 21, 22 are fixedly secured together. The first and second rings 41, 42 fixedly secured to the first and second half-spherical members 51, 52 are adapted to rotate about the first and second weight members 21, 22 respectively. The threaded holes 512 are aligned with a lengthwise axis of the handle 10.

Additionally, two flexible C-shaped rings 60 each has a threaded shank 61 adapted to secure to the threaded hole 512 so that the C-shaped rings 60 can be releasably mounted to the first and second half-spherical members 51, 52 respectively. That is, the first and second rings 41, 42 the first and second half-spherical members 51, 52, and the C-shaped rings 60 are adapted to rotate about the first and second weight members 21, 22 respectively.

Figure 5:
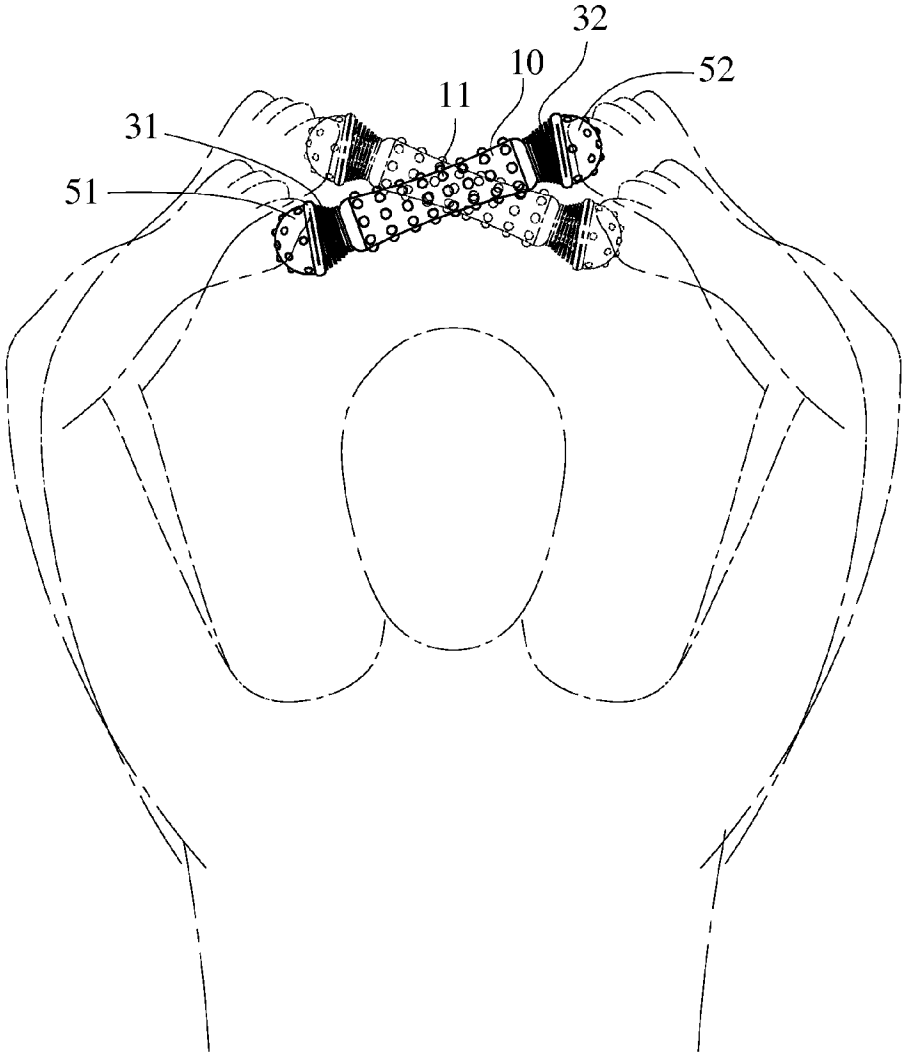
FIGS. 5 to 9 are views showing different exercise modes of an individual using the multifunction dumbbell in which in FIG. 7, the C-shaped rings are additionally used by the individual in cooperation with the multifunction dumbbell for exercise.
Figure 6:
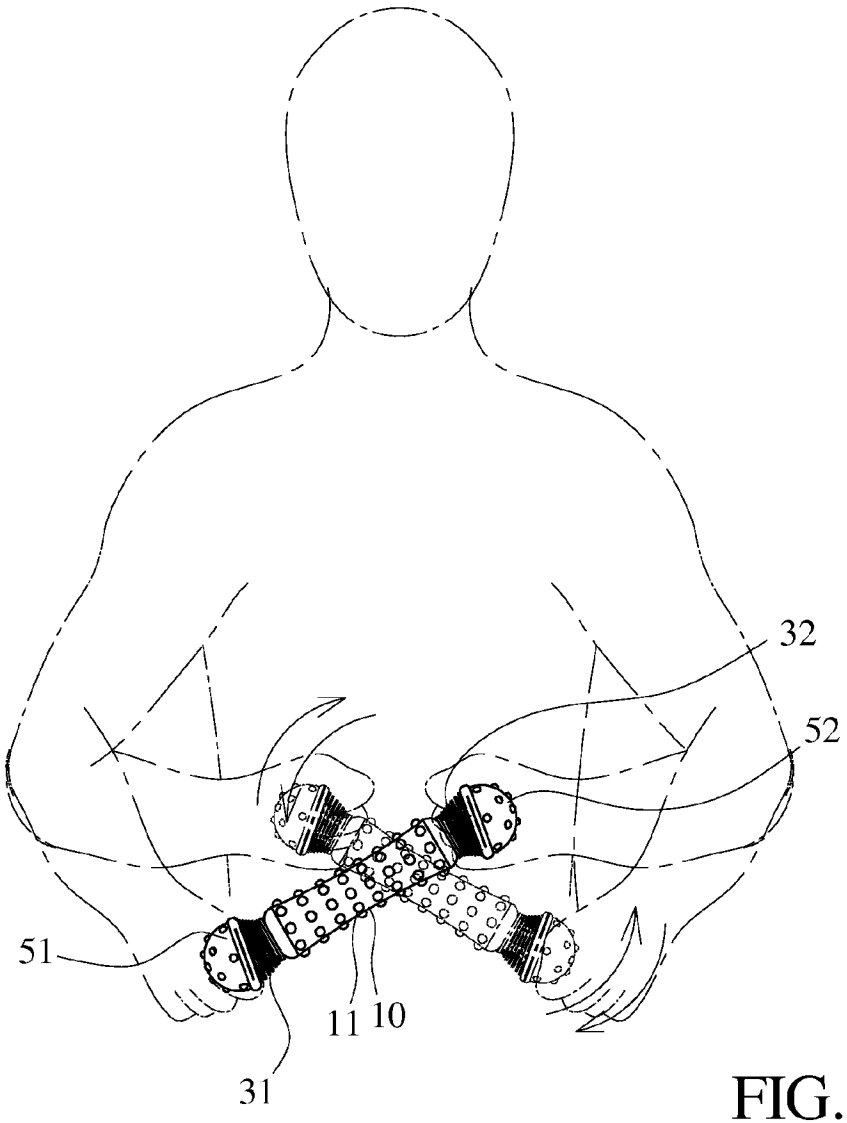

Operations and health benefits of the multifunction dumbbell are detailed below. An individual may use the dumbbell in weight training. Alternatively, an individual may use the hands to grip the first and second half-spherical members 51, 52 respectively and rotate similar to practicing "Tai Chi" (an internal Chinese martial art) as shown in FIGS. 5 and 6. This exercise mode has the health benefits of exercising the hands, the arms, and the upper torso.

Figure 7:
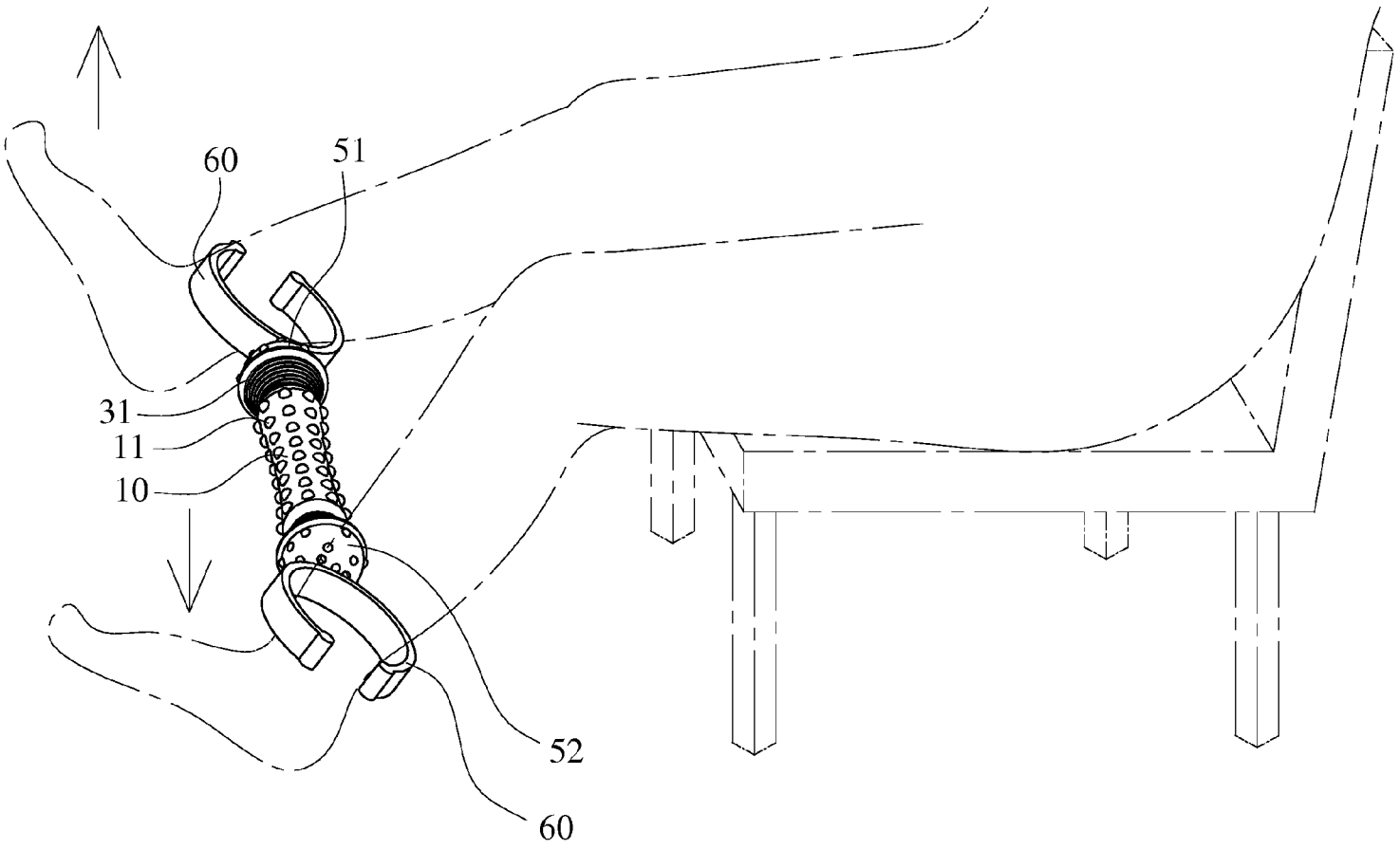

Still alternatively, an individual may mount the C-shaped rings 60 to the first and second half-spherical members 51, 52 respectively prior to putting the C-shaped rings 60 on both legs near the ankles as shown in FIG. 7. This exercise mode is similar to pedaling a bicycle and, thus, can exercise the legs.

Figure 8:
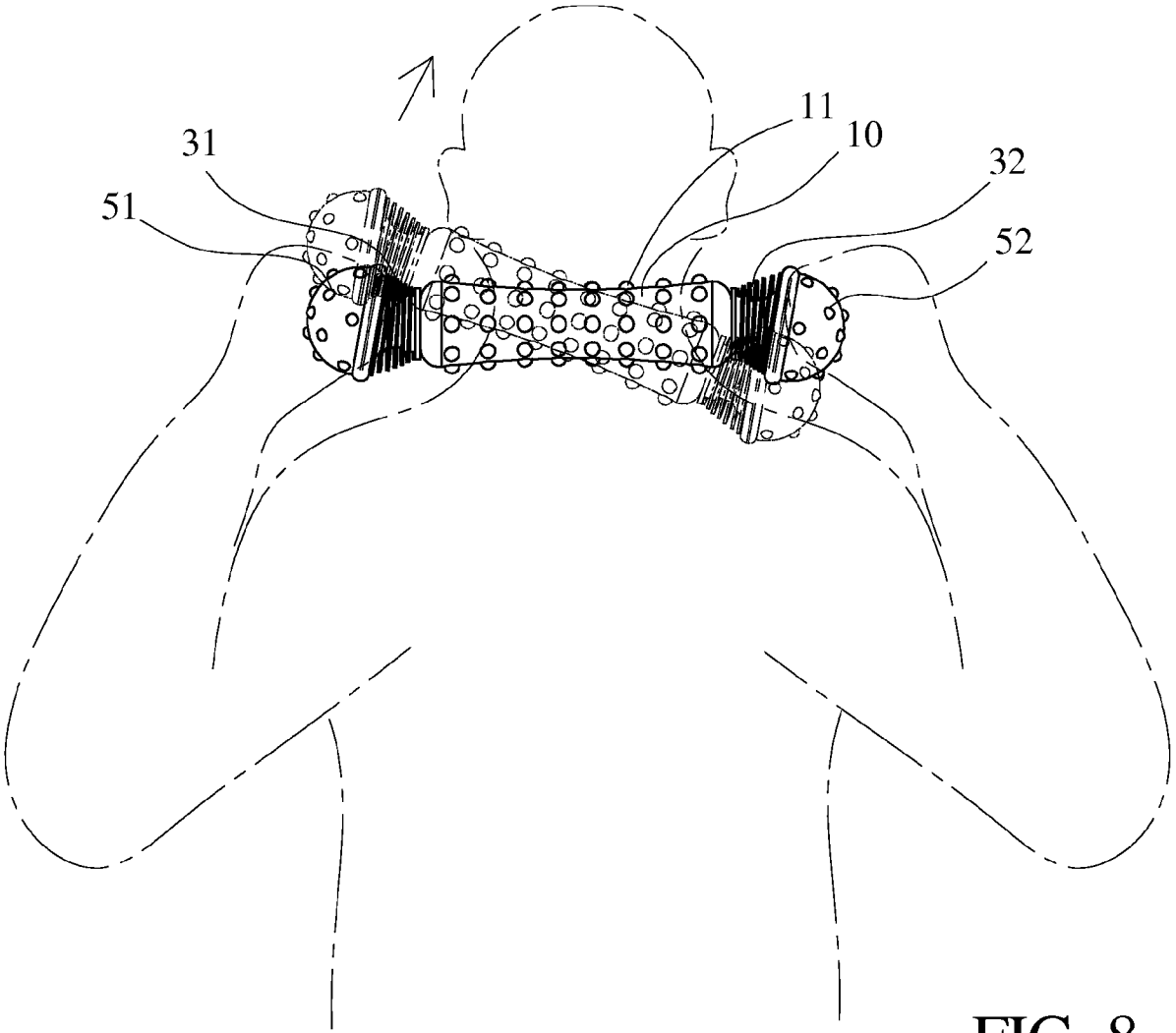

Still alternatively, an individual may rub the neck with the massaging knobs 11 by pressing and rotating the massaging knobs 11 as shown in FIG. 8. This can bring about a massaging effect.

Figure 9:
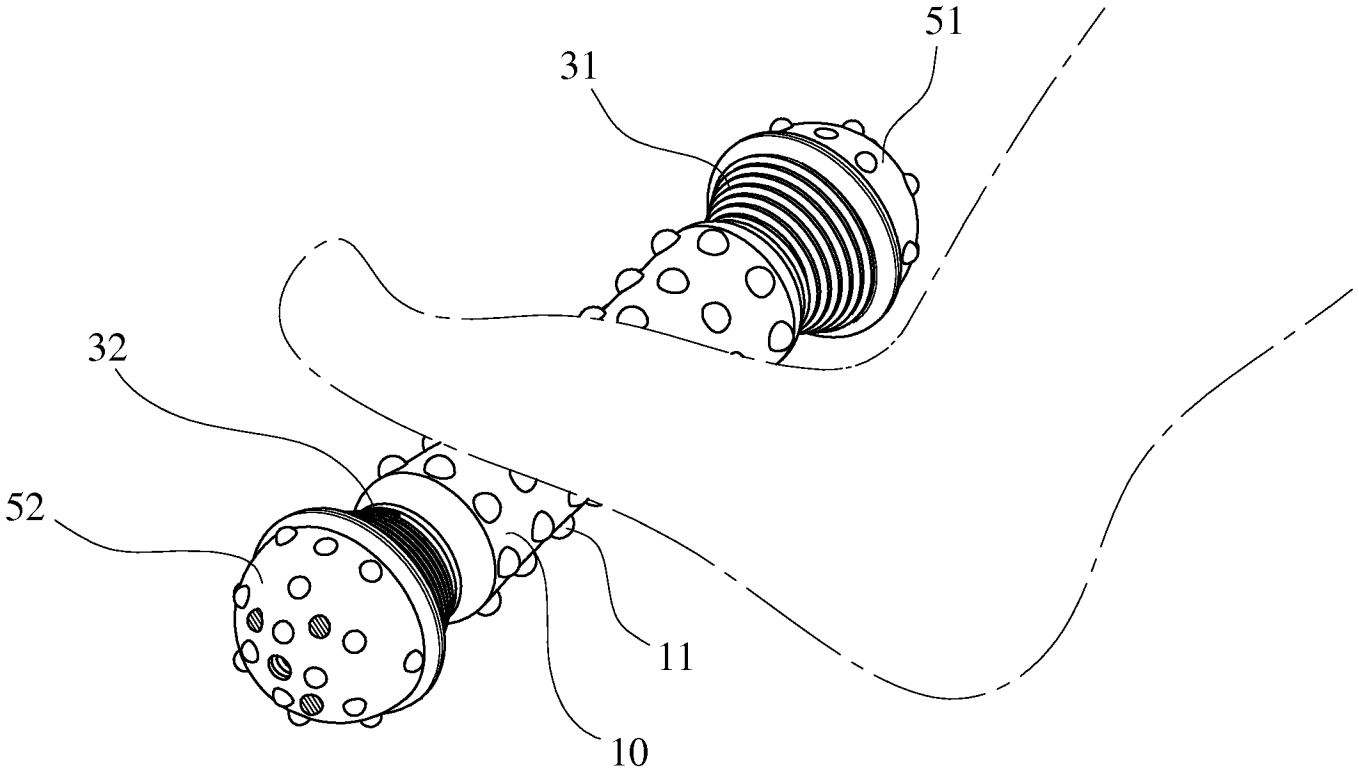

Still alternatively, an individual may rub the sole (i.e., the bottom of the foot) with the massaging knobs 11 by pressing and rotating the massaging knobs 11 as shown in FIG. 9. This also can bring about a massaging effect.

Figure 10:
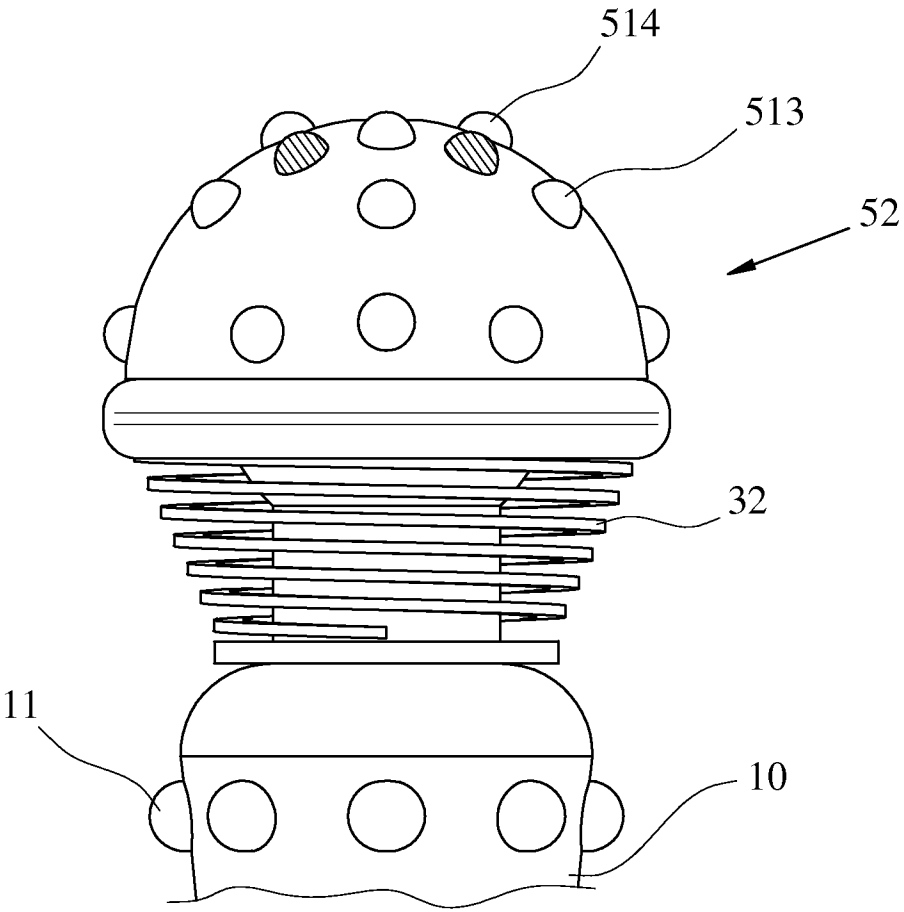
FIG. 10 is a side elevation of one end of the multifunction dumbbell of FIG. 2 showing the second half-spherical member, the second truncated conic spring, and adjacent components.
Figure 11:
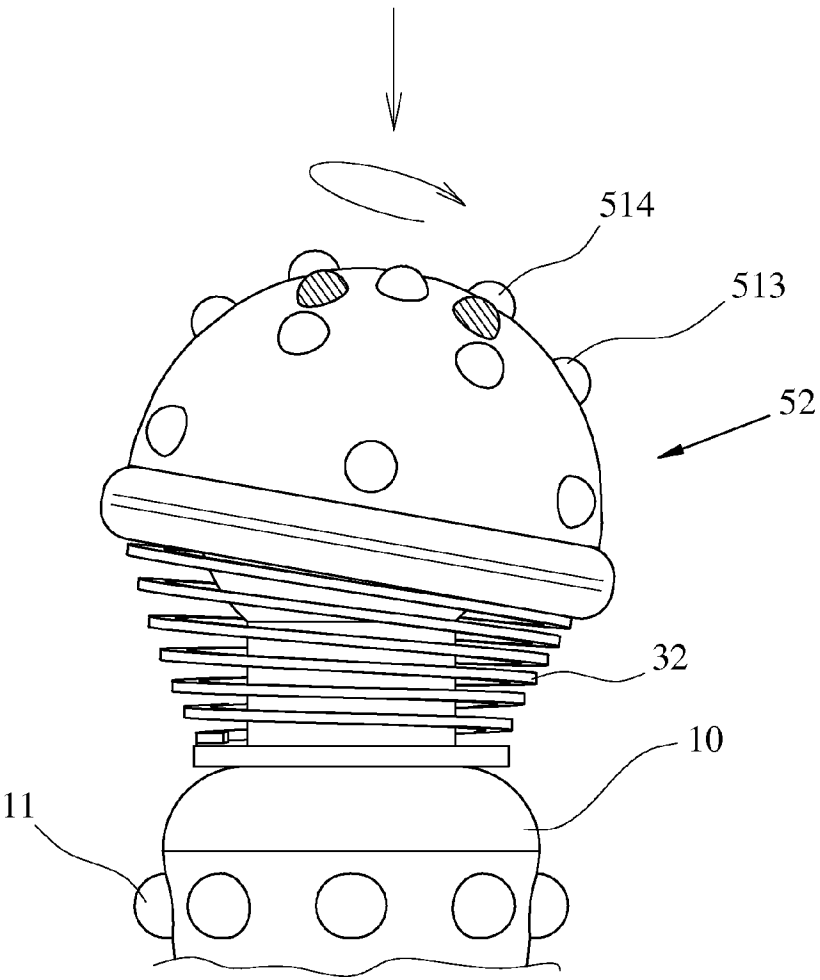
FIG. 11 is a view similar to FIG. 10 showing a clockwise rotation of the second half-spherical member with the second truncated conic spring compressed in the right side.
Figure 12:
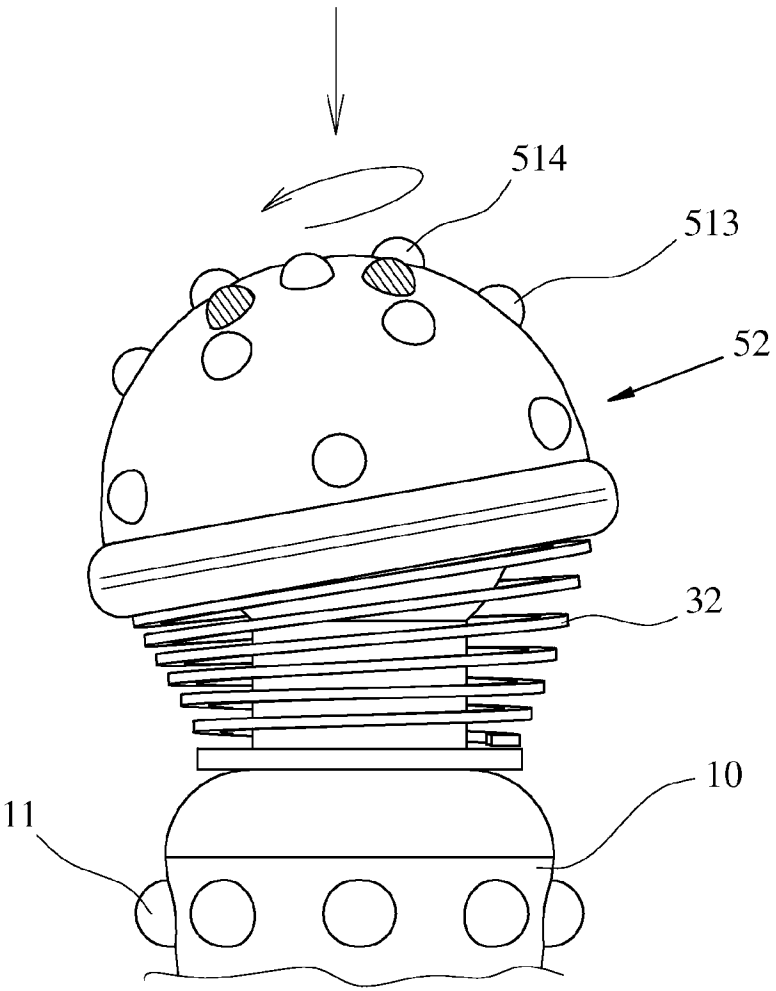
FIG. 12 is a view similar to FIG. 10 showing a counterclockwise rotation of the second half-spherical member with the second truncated conic spring compressed in the left side.

Referring to FIGS. 10 to 12, rotation of the second half-spherical member 52 by the hand for exercise and, thus, the compression of the second truncated conic spring 32 are shown. FIG. 11 shows a clockwise rotation of the second half-spherical member 52 with the second truncated conic spring 32 compressed in the right side as a result of force exerted by the hand. FIG. 12 shows a counterclockwise rotation of the second half-spherical member 52 with the second truncated conic spring 32 compressed in the left side also as a result of force exerted by the hand.

In brief, the multifunction dumbbell can help an exerciser achieve the purposes of physical exercise, massage, rehabilitation, physical fitness, and health improvement.

While the invention has been described in terms of preferred embodiments, those skilled in the art will recognize that the invention can be practiced with modifications within the spirit and scope of the appended claims.

What is claimed is:

1. A multifunction dumbbell comprising:

a handle comprising two projections on both ends respectively;

two hollow weight members each comprising a protrusion extending toward the handle;

two spacer sleeves each comprising a closed flange fixedly secured to a joining portion of the handle and one of the two projections, with the two spacer sleeves fixedly fastened between the protrusions of the two hollow weight members and the two projections;

two rings each having an inner diameter less than an outer diameter of each of the two hollow weight members, wherein the two rings are capable of placement on the two hollow weight members and retained thereon respectively;

two half-spherical members fixedly secured to the two rings respectively and each comprising a concave inner surface shaped to complimentarily engage with one of the two hollow weight members; and two truncated conic springs put on the protrusions and portions of the two hollow weight members to be retained between the two spacer sleeves and the two rings respectively, wherein the two rings and the two half-spherical members together are adapted to rotate about the two hollow weight members.

2. The multifunction dumbbell of claim 1, further comprising weights between one and seven kilograms for addition to each of the two hollow weight members.

3. The multifunction dumbbell of claim 2, wherein the closed flange of each of the two spacer sleeves is fixedly secured to the joining portion of the handle and one of the two projections by ultrasonic welding, and wherein the two protrusions are fixedly secured to the two spacer sleeves by ultrasonic welding.

4. The multifunction dumbbell of claim 3, wherein each of the two half-spherical members further comprises a threaded hole on an outer surface, with the multifunction dumbbell further comprising two flexible C-shaped rings each having a threaded shank adapted to secure to the threaded hole of one of the two half-spherical members.

5. The multifunction dumbbell of claim 4, wherein the handle further comprises a plurality of massaging knobs on an outer surface.

6. The multifunction dumbbell of claim 5, wherein each of the two half-spherical members further comprises a plurality of massaging knobs on the outer surface of each of the two half-spherical members.

7. The multifunction dumbbell of claim 5, wherein each of the two half-spherical members further comprises a plurality of magnets on the outer surface of each of the two half-spherical members.

* * * * *